US009000749B2

(12) United States Patent
Kobayashi

(10) Patent No.: US 9,000,749 B2
(45) Date of Patent: Apr. 7, 2015

(54) CONSTANT CURRENT CIRCUIT AND VOLTAGE REFERENCE CIRCUIT

(71) Applicant: Seiko Instruments Inc., Chiba-shi, Chiba (JP)

(72) Inventor: Yuji Kobayashi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 415 days.

(21) Appl. No.: 13/660,408

(22) Filed: Oct. 25, 2012

(65) Prior Publication Data

US 2013/0106394 A1 May 2, 2013

(30) Foreign Application Priority Data

Oct. 31, 2011 (JP) ..... 2011-239421

(51) Int. Cl.
*G05F 3/16* (2006.01)
*G05F 3/24* (2006.01)

(52) U.S. Cl.
CPC ..... *G05F 3/242* (2013.01)

(58) Field of Classification Search
USPC ..... 323/313, 314, 315
See application file for complete search history.

(56) References Cited

U.S. PATENT DOCUMENTS

| | | | | |
|---|---|---|---|---|
| 4,506,208 | A * | 3/1985 | Nagano | 323/314 |
| 5,391,979 | A * | 2/1995 | Kajimoto et al. | 323/313 |
| 5,436,552 | A * | 7/1995 | Kajimoto | 323/313 |
| 5,838,188 | A * | 11/1998 | Taguchi | 327/530 |
| 2005/0151527 | A1 * | 7/2005 | Noda | 323/313 |
| 2011/0175593 | A1 * | 7/2011 | Ookuma | 323/313 |
| 2011/0199069 | A1 * | 8/2011 | Singnurkar | 323/313 |
| 2013/0106394 | A1 * | 5/2013 | Kobayashi | 323/314 |

FOREIGN PATENT DOCUMENTS

JP 03-238513 A 10/1991

* cited by examiner

*Primary Examiner* — Jeffrey Sterrett
(74) *Attorney, Agent, or Firm* — Brinks Gilson & Lione

(57) ABSTRACT

Provided is a constant current circuit in which an enhancement N-channel transistor can operate in a weak-inversion state even at high temperatures. A constant current circuit includes a current mirror circuit, a constant-current generation block circuit, and an off-leak circuit, wherein the off-leak circuit is constituted by a first enhancement N-channel transistor having a gate and a source connected to an earth terminal and a drain connected to an output of the constant current circuit. This suppresses an increase in a gate-to-source voltage of the enhancement N-channel transistor which generates a constant current, thereby maintaining its operation in a weak-inversion state.

10 Claims, 6 Drawing Sheets

CONSTANT CURRENT CIRCUIT AND VOLTAGE REFERENCE CIRCUIT

RELATED APPLICATIONS

This application claims priority under 35 U.S.C. §119 to Japanese Patent Application No. 2011-239421 filed on Oct. 31, 2011, the entire content of which is hereby incorporated by reference.

BACKGROUND OF THE INVENTION

1. Field of the Invention

The present invention relates to a constant current circuit and a voltage reference circuit using the same, and more specifically, to a constant current circuit which can maintain operation in a weak-inversion state even if a junction current flowing between a drain and a substrate and between a source and the substrate occurs at high temperatures.

2. Description of the Related Art

The following describes a conventional constant current circuit. FIG. 6 is a circuit diagram of the conventional constant current circuit. The conventional constant current circuit is constituted by enhancement N-channel transistors 61 and 62 having different K values, enhancement P-channel transistors 63 and 64, a resistor 65, an earth terminal 100, and a power supply terminal 101. A K value is obtained according to $K=W/L\cdot(\mu Cox/2)$, where W denotes a gate width of a transistor, L denotes a gate length of the transistor, μ denotes a mobility of a carrier, and Cox denotes a gate oxide capacitance per unit area.

In the enhancement N-channel transistor 61, its source is connected to the earth terminal 100, and its drain and gate are connected to a gate of the enhancement N-channel transistor 62 and a drain of the enhancement P-channel transistor 63. In the enhancement N-channel transistor 62, its source is connected to the earth terminal 100 via the resistor 65, and its drain is connected to a gate and a drain of the enhancement P-channel transistor 64 and a gate of the enhancement P-channel transistor 63. Sources of the enhancement P-channel transistors 63 and 64 are both connected to the power supply terminal 101.

A K value of the enhancement N-channel transistor 61 is smaller than a K value of the enhancement N-channel transistor 62. A gate-to-source voltage difference between the enhancement N-channel transistor 61 and the enhancement N-channel transistor 62 occurs in the resistor 65, and a current flowing in the resistor 65 is mirrored by the enhancement P-channel transistors 63 and 64 so as to generate a bias current.

[Patent Document 1] Japanese Patent Application Laid-Open No. 3-238513 (FIG. 4 (a))

SUMMARY OF THE INVENTION

However, in the conventional constant current circuit, due to a junction current occurring between the drain and the substrate or between the source and the substrate at high temperatures, the gate-to-source voltage difference between the enhancement N-channel transistors 61 and 62 increases, which causes a problem that the enhancement N-channel transistors 61 and 62 do not operate in a weak-inversion state.

The present invention is accomplished in view of the above problem so as to realize a constant current circuit in which an enhancement N-channel transistor can operate in a weak-inversion state even at high temperatures.

In order to solve the conventional problem, a constant current circuit of the present invention is configured as follows. A constant current circuit includes: a current mirror circuit, a constant-current generation block circuit, and an off-leak circuit, wherein the off-leak circuit is constituted by a first enhancement N-channel transistor having a gate and a source connected to an earth terminal and a drain connected to an output of the constant current circuit.

According to the constant current circuit of the present invention, an increase in a potential of an output voltage can be suppressed at high temperatures by using an off-leak circuit, and an enhancement N-channel transistor can be operated in a weak-inversion state.

DETAILED DESCRIPTION OF THE PREFERRED EMBODIMENTS

The following describes embodiments of the present invention with reference to drawings.

First Embodiment

Figure 1:
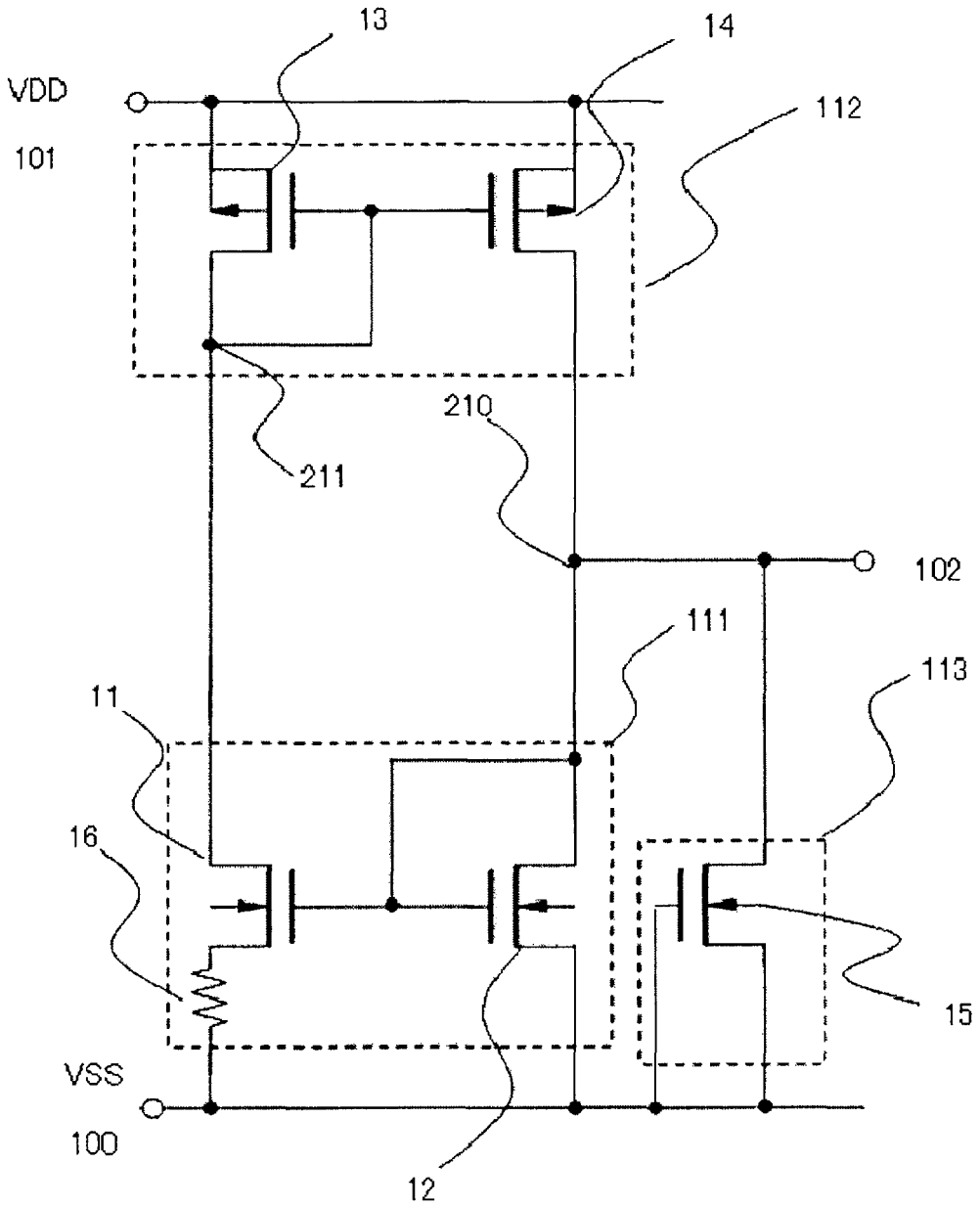
FIG. 1 is a circuit diagram illustrating a constant current circuit according to a first embodiment.

FIG. 1 is a circuit diagram illustrating a constant current circuit according to a first embodiment. The constant current circuit of the first embodiment is constituted by a constant-current generation block circuit 111, a current mirror circuit 112, an off-leak circuit 113, an earth terminal 100, a power supply terminal 101, and an output terminal 102. The constant-current generation block circuit 111 includes enhancement N-channel transistors 11 and 12 of which respective gates are connected to each other, and a resistor 16. The current mirror circuit 112 includes enhancement P-channel transistors 13 and 14 of which respective gates are connected to each other. The off-leak circuit 113 is constituted by an enhancement N-channel transistor 15.

The following describes connection. In the enhancement N-channel transistor 11, its drain is connected to a drain and a gate of the enhancement P-channel transistor 13 of the current mirror circuit 112, and its source is connected to the earth terminal 100 via the resistor 16. In the enhancement N-channel transistor 12, its gate and drain are connected to a drain of the enhancement P-channel transistor 14 of the current mirror circuit 112 and the output terminal 102, and its source is connected to the earth terminal 100. Sources of the enhancement P-channel transistors 13 and 14 are connected to the power supply terminal 101. In the enhancement N-channel transistor 15 of the off-leak circuit 113, its drain is connected to the output terminal 102, and its source and gate are connected to the earth terminal 100.

The following describes operation.

Generally, during operation in a temperature range in which a junction current is so small to be ignored, a current flowing in the enhancement N-channel transistor 11 is equal to a current flowing in the enhancement P-channel transistor 13. A current flowing in the enhancement N-channel transistor 12 is equal to a current flowing in the enhancement P-channel transistor 14. A K value of the enhancement N-channel transistor 11 is different from a K value of the enhancement N-channel transistor 12. Accordingly, a bias current is generated by applying, to the resistor, a difference voltage between a gate-to-source voltage of the enhancement N-channel transistor 11 and a gate-to-source voltage of the enhancement N-channel transistor 12, and the bias current can be expressed with the following (1) formula:

$$Ibias = \frac{V_{gs12} - V_{gs11}}{R_{15}} \quad (1)$$

where $V_{gs11}$ and $V_{gs12}$ denote gate-to-source voltages of the transistors 11 and 12, $R_{15}$ denotes a resistor, and Ibias denotes a bias current. Further, when the enhancement N-channel transistors 11 and 12 have gate-to-source voltages lower than threshold values, the transistors operate in a weak-inversion state, and a relation between the gate-to-source voltage $V_{gs}$ and a drain current $I_d$ is expressed with the following (2) formula:

$$V_{gs} = \frac{nkT}{q} \cdot \ln\left(\frac{I_d}{I_{d0} \cdot W/L}\right) + V_{th} \quad (2)$$

where $I_{d0}$ denotes a constant determined by a process, W denotes a gate width, L denotes a gate length, and $V_{th}$ denotes a threshold value. Accordingly, from the two formulae (1) and (2), as the bias current of the constant current circuit operating in a weak-inversion state, a current proportional to nkT/q flows.

Note that it is desirable that a K value of the enhancement N-channel transistor 15 be not less than a value obtained by deducting the K value of the enhancement N-channel transistor 12 from the K value of the enhancement N-channel transistor 11.

The enhancement N-channel transistor 15 constitutes an off-leak circuit. In the enhancement N-channel transistor 15, a source-to-gate voltage is always 0 and a current flowing in its drain is a backward diode current due to a parasitic diode between the drain and the substrate.

When the temperature becomes high, a drain current of the enhancement N-channel transistor 11 increases due to a junction current flowing between substrates. Due to the current mirror circuit, a current in the same amount as the drain current of the enhancement N-channel transistor 11 flows in the enhancement N-channel transistors 12 and 15.

Since the K value of the enhancement N-channel transistor 11 is larger than the K value of the enhancement N-channel transistor 12, an increasing amount of a junction current of the enhancement N-channel transistor 11 is larger than an increasing amount of a junction current of the enhancement N-channel transistor 12.

A drain current of the enhancement N-channel transistor 15 flows a difference between the junction current of the enhancement N-channel transistor 11 and the junction current of the enhancement N-channel transistor 12. This does not cause the drain current of the enhancement N-channel transistor 11 to increase other currents except for its own junction current. Accordingly, an increase in a potential of the output terminal 102, that is, increases in gate-to-source voltages of the enhancement N-channel transistors 11 and 12 can be suppressed.

Further, when the enhancement N-channel transistors 11 and 12 which determine a constant current source and the enhancement N-channel transistor of the off-leak circuit are placed on the same well, there is no influence by element variability and temperature change and the same junction current flows. This makes it possible to obtain a stable characteristic even if there is variability of characteristics due to process dependency.

As such, when the off-leak circuit as illustrated in FIG. 1 is provided, a surplus current of the junction current of the enhancement N-channel transistor 11 can be synchronized even at high temperatures so as to suppress an increase in the potential of the output terminal 102 caused along with the junction current, and the enhancement N-channel transistors 11 and 12 can maintain their operation in a weak-inversion state.

Second Embodiment

Figure 2:
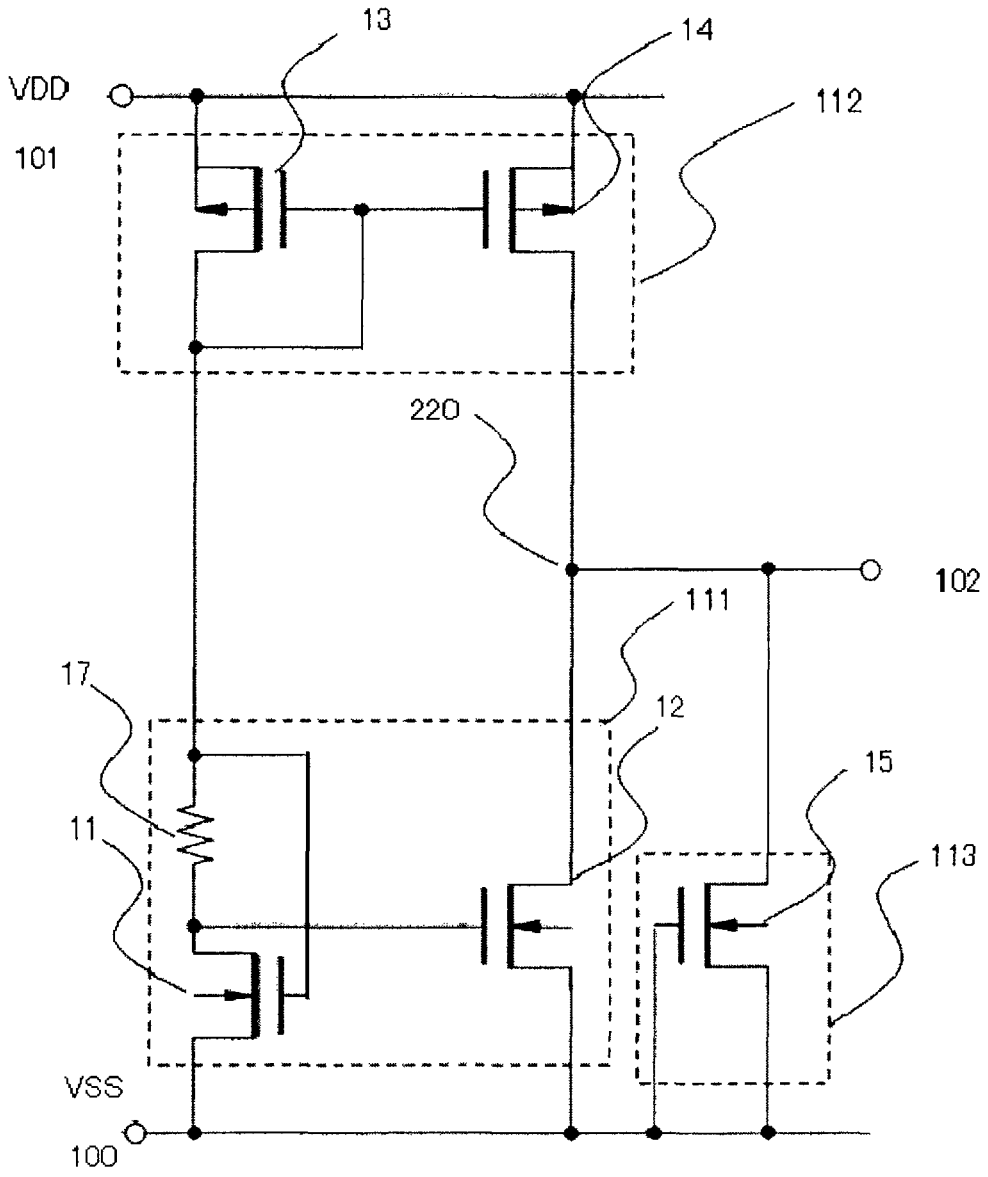
FIG. 2 is a circuit diagram illustrating a constant current circuit according to a second embodiment.

FIG. 2 is a circuit diagram of a constant current circuit illustrating a second embodiment of the constant-current generation block circuit 111.

A difference to the constant-current generation block circuit 111 of FIG. 1 is that a gate of an enhancement N-channel transistor 12 is connected to a drain of an enhancement N-channel transistor 11, and a resistor 17 is connected between a drain and a gate of the enhancement N-channel transistor 11. A circuit configuration is such that a K value of the enhancement N-channel transistor 12 is smaller than a K value of the enhancement N-channel transistor 11 and a gate-to-drain voltage difference between the enhancement N-channel transistor 12 and the enhancement N-channel transistor 11 occurs at the resistor 17 so as to generate a bias current.

Even in such a constant-current generation block circuit, with the use of an off-leak circuit 113 flowing a difference between a junction current of the enhancement N-channel transistor 11 and a junction current of the enhancement N-channel transistor 12, the enhancement N-channel transistors 11 and 12 can maintain their operation in a weak-inversion state.

Accordingly, if a constant current circuit which operates enhancement N-channel transistors in a weak-inversion state and which flows a current proportional to nkT/q includes an off-leak circuit, the advantage of the present invention can be obtained.

Note that the enhancement N-channel transistors 11 and 12 which constitute a constant-current generation block circuit may be configured by connecting a plurality of transistors in parallel.

Further, the current mirror circuit 112 may not be constituted by enhancement P-channel transistors provided that the current mirror circuit 112 is constituted by two or more transistors which have the same K value and of which respective gates are connected to each other.

Third Embodiment

Figure 3:
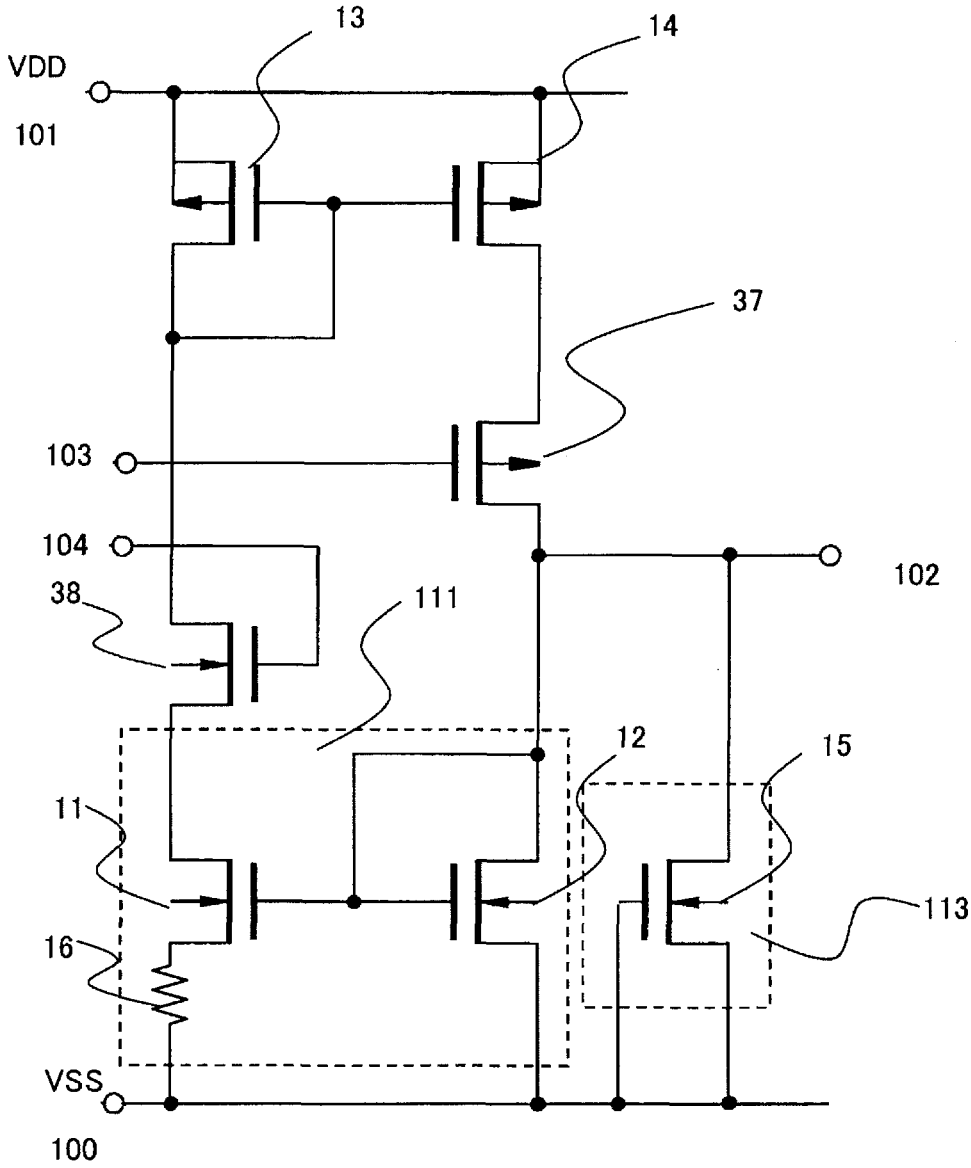
FIG. 3 is a circuit diagram illustrating a constant current circuit according to a third embodiment.

FIG. 3 is a circuit diagram of a constant current circuit illustrating a third embodiment.

A difference to FIG. 1 is that an enhancement N-channel transistor 38 is connected between a drain of an enhancement P-channel transistor 13 and an enhancement N-channel transistor 11, and the enhancement P-channel transistor 37 is connected between a drain of an enhancement P-channel transistor 14 and an output terminal 102. A gate of the enhancement N-channel transistor 38 is connected to an N-channel cascode terminal 104, and a gate of the enhancement N-channel transistor 37 is connected to an N-channel cascode terminal 103.

The following describes operation. When a junction current begins to flow at a high temperature, an off-leak circuit 113 tries to keep the enhancement N-channel transistors 11 and 12 operating in a weak-inversion state so as to synchronize a surplus junction current, similarly to the operation of FIG. 1. Further, due to a cascode circuit of the enhancement P-channel transistor 37, a channel modulation effect of the enhancement P-channel transistor 14 is suppressed, and due to a cascode circuit of the enhancement N-channel transistor 38, a channel modulation effect of the enhancement N-channel transistor 11 is suppressed. As a result, a power supply potential dependency is improved as compared with the constant current circuit of FIG. 1.

As such, with the use of the off-leak circuit 113, the enhancement N-channel transistors 11 and 12 can maintain their operation in a weak-inversion state. Further, the power supply potential dependency can be improved.

Fourth Embodiment

Figure 4:
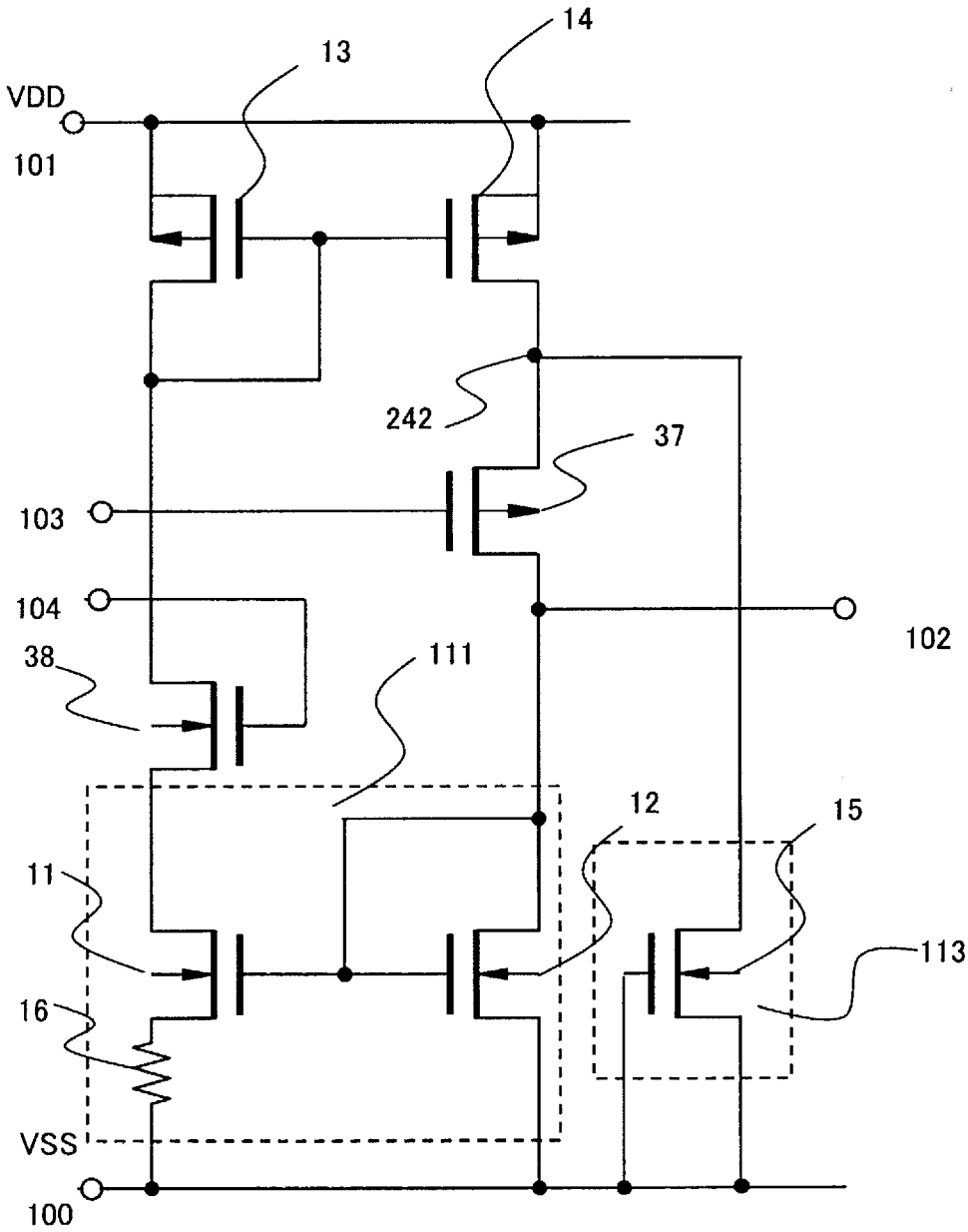
FIG. 4 is a circuit diagram illustrating a constant current circuit according to a fourth embodiment.

FIG. 4 is a circuit diagram of a constant current circuit illustrating a fourth embodiment.

A difference to FIG. 3 is that a drain of an enhancement N-channel transistor 15 which constitutes an off-leak circuit 113 is connected between a drain of an enhancement P-channel transistor 14 and a source of an enhancement P-channel transistor 37. By changing a connecting point, a voltage applied to the drain of the enhancement N-channel transistor 15 becomes a voltage of a power-supply potential reference, so that a current which can synchronize a junction current can be increased slightly.

Even in such a constant-current generation block circuit, with the use of the off-leak circuit 113 flowing a difference between a junction current of an enhancement N-channel transistor 11 and a junction current of an enhancement N-channel transistor 12, the enhancement N-channel transistors 11 and 12 can maintain their operation in a weak-inversion state.

Note that the drain of the enhancement N-channel transistor of the off-leak circuit can be connected to any position provided that the position is between the drain of the enhancement N-channel transistor having a low K value in the constant-current generation block circuit 111 and the current mirror circuit 112.

Fifth Embodiment

Figure 5:
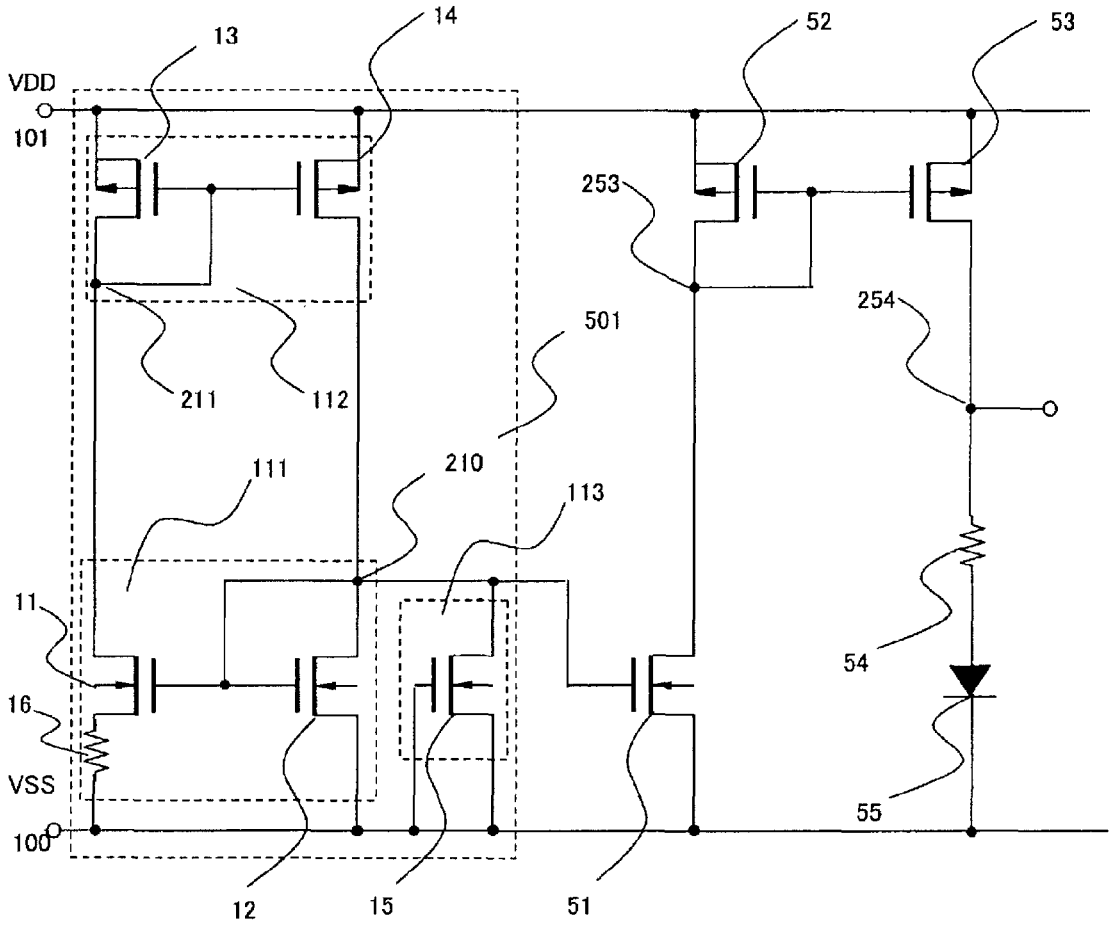
FIG. 5 is a circuit diagram illustrating a voltage reference circuit using a constant current circuit of the present invention.
Figure 6:
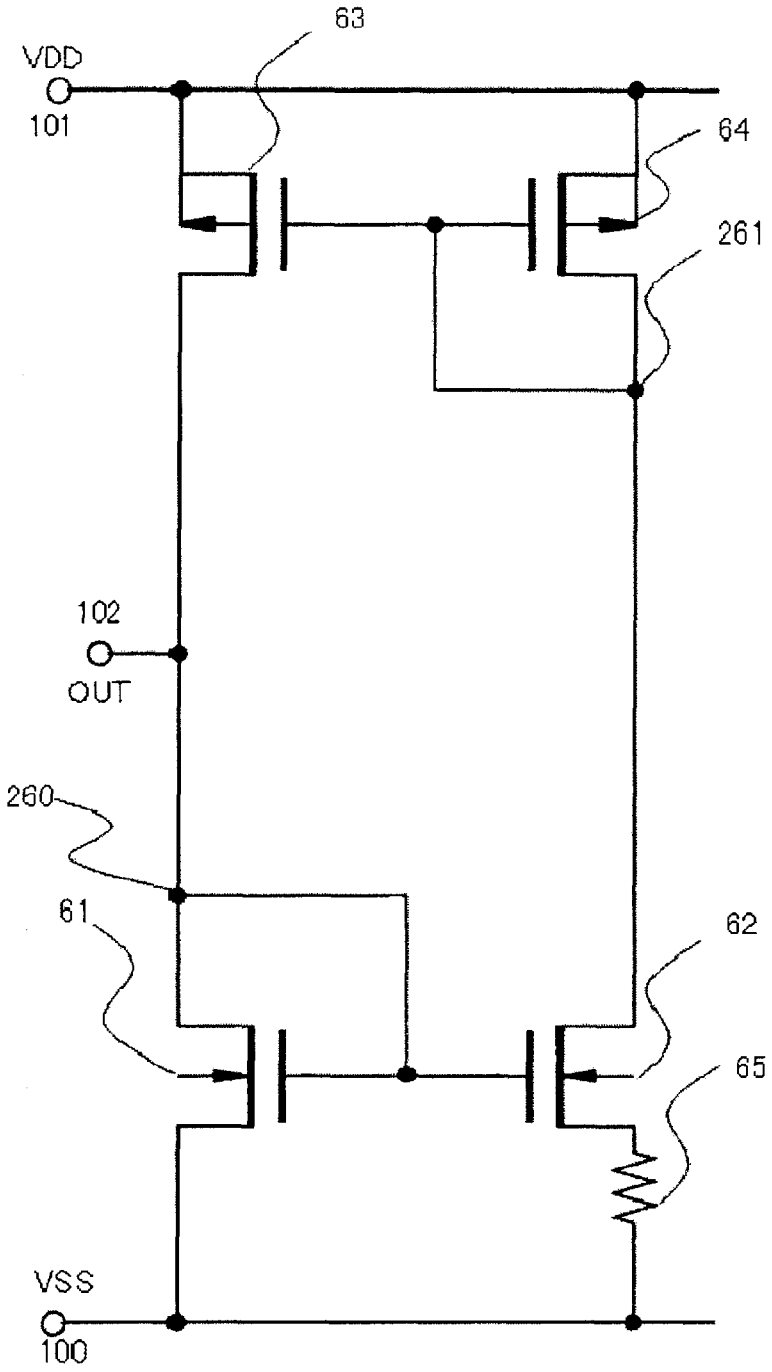
FIG. 6 PRIOR ART
FIG. 6 is a circuit diagram illustrating a conventional constant current circuit.

FIG. 5 is a circuit diagram illustrating a voltage reference circuit using a constant current circuit of the present invention.

The voltage reference circuit of FIG. 5 includes enhancement N-channel transistors 11 and 12 and a resistor 16 constituting a constant-current generation block circuit 111, enhancement P-channel transistors 13 and 14 constituting a current mirror circuit 112, an enhancement N-channel transistor 15 constituting an off-leak circuit 113, enhancement P-channel transistors 52 and 53, an enhancement N-channel transistor 51, a resistor 54, and a diode 55. The constant-current generation block circuit 111, the current mirror circuit 112, and the off-leak circuit 113 constitute a constant current circuit 501, and have the same configuration same as in FIG. 1.

In the enhancement N-channel transistor 51, its gate is connected to a connecting point 210, its drain is connected to a drain and a gate of the enhancement P-channel transistor 52, and its source and substrate is connected to an earth terminal 100. In the enhancement P-channel transistor 52, its gate is connected to a gate of the enhancement P-channel transistor 53, and its source and substrate are connected to the power supply terminal 101. In the enhancement P-channel transistor 53, its gate is connected to a connecting point 253, its drain is connected to the reference voltage output terminal 105, and its source and substrate are connected to the power supply terminal 101. In the resistor 54, one terminal is connected to the reference voltage output terminal 105, and the other terminal is connected to an anode of the diode 55. In the diode 55, its cathode is connected to the earth terminal 100.

The following describes operation. The operation of the constant current circuit 501 is similar to the explanation of FIG. 1. Accordingly, since the off-leak circuit 113 is provided, a surplus current of a junction current of the enhancement N-channel transistor 11 can be synchronized even at high temperatures so as to suppress an increase in a potential of the connecting point 210 caused along with the junction current. Thus, the enhancement N-channel transistors 11 and 12 can maintain their operation in a weak-inversion state.

A bias current of the constant current circuit 501 is received by the enhancement N-channel transistor 51 and flows into the resistor 54 and the diode 55 via a current mirror circuit constituted by the enhancement P-channel transistors 52 and 53. Here, when the resistor 16 is constituted by a resistor which is the same type as the resistor 54, a temperature coefficient of the resistor is canceled. Consequently, at both ends of the resistor 54, voltages having positive temperature coefficients proportional to nkT/q occur.

On the other hand, voltages at both ends of the diode 40 have negative temperature coefficients of around −2 mV. By setting temperature coefficients of the resistor 16 and the resistor 54 so that the temperature coefficients of the voltages at both ends of the resistor 54 and the temperature coefficients of the voltages at both ends of the diode 55 are offset, a reference voltage which does not depend on temperature can be obtained from both ends of the reference voltage output terminal 105 and the earth terminal 100.

Note that the constant current circuit may be a circuit that is illustrated in any of the other examples.

In this way, a reference voltage which does not depend on temperature can be obtained by constituting a voltage reference circuit by using the constant current circuit 501.

What is claimed is:

1. A constant current circuit comprising:

a current mirror circuit;

a constant-current generation block circuit; and an off-leak circuit constituted by a first enhancement N-channel transistor having a gate and a source connected to an earth terminal and a drain connected to an output of the constant current circuit, and synchronizing a surplus current flowing in the constant-current generation block circuit at high temperatures.

2. The constant current circuit according to claim 1, wherein the constant-current generation block circuit includes:

a second enhancement N-channel transistor having a gate and a drain connected to each other and a source connected to the earth terminal; and a third enhancement N-channel transistor having a gate connected to the gate of the second enhancement N-channel transistor while a first resistor is connected between a source of the third enhancement N-channel transistor and the earth terminal.

3. A voltage reference circuit comprising:

a constant current circuit according to claims 2;

a sixth enhancement N-channel transistor having a gate connected to an output terminal of the constant current circuit;

a second current mirror circuit having an input terminal connected to the sixth enhancement N-channel transistor; and a third resistor and a diode connected to an output terminal of the second current mirror circuit.

4. The constant current circuit according to claim 1, wherein a cascode transistor is connected between the constant-current generation block circuit and the current mirror circuit.

5. The constant current circuit according to claim 4, wherein the off-leak circuit has a drain connected between the current mirror circuit and the cascode transistor.

6. A voltage reference circuit comprising:

a constant current circuit according to claims 5;

a sixth enhancement N-channel transistor having a gate connected to an output terminal of the constant current circuit;

a second current mirror circuit having an input terminal connected to the sixth enhancement N-channel transistor; and a third resistor and a diode connected to an output terminal of the second current mirror circuit.

7. A voltage reference circuit comprising:

a constant current circuit according to claim 4;

a sixth enhancement N-channel transistor having a gate connected to an output terminal of the constant current circuit;

a second current mirror circuit having an input terminal connected to the sixth enhancement N-channel transistor; and a third resistor and a diode connected to an output terminal of the second current mirror circuit.

8. The constant current circuit according to claim 1, wherein the constant-current generation block circuit includes:

a fourth enhancement N-channel transistor having a gate and a drain between which a second resistor is connected and a source connected to the earth terminal; and a fifth enhancement N-channel transistor having a gate connected to the drain of the fourth enhancement N-channel transistor and a source connected to the earth terminal.

9. A voltage reference circuit comprising:

a constant current circuit according to claims 8;

a sixth enhancement N-channel transistor having a gate connected to an output terminal of the constant current circuit;

a second current mirror circuit having an input terminal connected to the sixth enhancement N-channel transistor; and a third resistor and a diode connected to an output terminal of the second current mirror circuit.

10. A voltage reference circuit comprising:

a constant current circuit according to claims 1;

a sixth enhancement N-channel transistor having a gate connected to an output terminal of the constant current circuit;

a second current mirror circuit having an input terminal connected to the sixth enhancement N-channel transistor; and a third resistor and a diode connected to an output terminal of the second current mirror circuit.

* * * * *

UNITED STATES PATENT AND TRADEMARK OFFICE

CERTIFICATE OF CORRECTION

PATENT NO. : 9,000,749 B2
APPLICATION NO. : 13/660408
DATED : April 7, 2015
INVENTOR(S) : Yuji Kobayashi It is certified that error appears in the above-identified patent and that said Letters Patent is hereby corrected as shown below:

In the Claims

Column 7, claim 3, line 13, replace “claims 2” with --claim 2--.

Column 7, claim 6, line 30, replace “claims 5” with --claim 5--.

Column 8, claim 9, line 22, replace “claims 8” with --claim 8--.

Column 8, claim 10, line 32, replace “claims 1” with --claim 1--.

Signed and Sealed this
Twelfth Day of January, 2016

Michelle K. Lee

Michelle K. Lee
*Director of the United States Patent and Trademark Office*